US007073756B1

(12) United States Patent
Walton

(10) Patent No.: US 7,073,756 B1
(45) Date of Patent: Jul. 11, 2006

(54) RECESSED SUPPORT ASSEMBLY

(75) Inventor: Toby Evans Walton, Washington, MA (US)

(73) Assignee: Dorothy Goodrich Walton, Washington, MA (US)

( * ) Notice: Subject to any disclaimer, the term of this patent is extended or adjusted under 35 U.S.C. 154(b) by 0 days.

(21) Appl. No.: 10/444,362

(22) Filed: May 23, 2003

Related U.S. Application Data

(60) Provisional application No. 60/384,729, filed on May 31, 2002.

(51) Int. Cl.
*F16M 11/20* (2006.01)
*A47C 7/00* (2006.01)

(52) U.S. Cl. ..... 248/188.1; 248/188.4; 248/188.91; 297/440.1; 297/440.23; 312/140

(58) Field of Classification Search ..... 248/188, 248/188.4, 188.1, 188.91, 220.1, 220.21, 248/220.41; 297/440.23, 440.13, 440.14, 297/440.15, 440.1; 312/140, 400
See application file for complete search history.

(56) References Cited

U.S. PATENT DOCUMENTS

| | | | | |
|---|---|---|---|---|
| D3,610 | S | | 8/1869 | Hutchinson |
| D15,053 | S | | 6/1884 | Hale |
| D25,362 | S | | 4/1896 | Brill |
| D26,068 | S | | 9/1896 | Brill |
| D34,325 | S | | 4/1901 | Kling |
| D38,076 | S | | 6/1906 | Kilburn |
| D38,839 | S | | 9/1907 | Kilburn |
| D67,519 | S | | 6/1925 | Hansen |
| D81,129 | S | | 5/1930 | Fabbro |
| 1,862,382 | A | | 6/1932 | Mathis |
| D96,286 | S | | 7/1935 | Ward, Jr. |
| D99,592 | S | | 5/1936 | Bond, Jr. |
| D105,186 | S | | 6/1937 | Sellers |
| D106,693 | S | | 10/1937 | Loewy |
| D110,563 | S | | 7/1938 | Hurwitz |
| 2,129,211 | A | | 9/1938 | Hickl |
| D113,372 | S | | 2/1939 | Bond, Jr. |
| D118,860 | S | | 2/1940 | Logan |
| D121,870 | S | | 8/1940 | Henkel et al. |
| D123,703 | S | | 11/1940 | Smith |
| D123,901 | S | | 12/1940 | Bond, Jr. |
| D132,348 | S | | 5/1942 | Saltman |
| D145,972 | S | | 11/1946 | Bond, Jr. |
| D148,598 | S | | 2/1948 | Anderson et al. |
| 2,540,056 | A | * | 1/1951 | Robinson ..... 251/286 |
| D163,883 | S | | 7/1951 | Lindberg |
| D163,941 | S | | 7/1951 | Frost |
| D169,473 | S | | 5/1953 | Brulin et al. |
| 2,650,657 | A | * | 9/1953 | Ohlsson ..... 297/440.23 |

(Continued)

*Primary Examiner*—Anita King
*Assistant Examiner*—Tan Le
(74) *Attorney, Agent, or Firm*—McCormick, Paulding & Huber LLP

(57) ABSTRACT

A recessed support assembly includes a ledge member having an upper portion and an attachment bore formed in the ledge member. A bracket conforms to the upper portion and includes a securement aperture aligned with the attachment bore. A first fastening device extends through the securement aperture and into the attachment bore, thus fixing the bracket to the ledge member. A bridging element is also included and is mated to the bracket via a second fastening device, which extends through an attachment aperture in the bracket and into the bridging element. An operative end of the second fastening device is captured between the bracket and the upper portion of the ledge.

1 Claim, 13 Drawing Sheets

U.S. PATENT DOCUMENTS 2,659,422 A 11/1953 Holland
D183,508 S 9/1958 Battle
D192,243 S 2/1962 Williams
D210,364 S 3/1968 Lindberg
D212,292 S 9/1968 Yermakov
3,748,012 A 7/1973 Abelman
3,756,657 A 9/1973 Johnson
D230,116 S 1/1974 Beams
D230,384 S 2/1974 Bialosky
3,887,234 A 6/1975 Curtis et al.
D238,993 S 3/1976 Schultz
D244,735 S 6/1977 Kennedy, Jr. et al.
D247,082 S 1/1978 Thompson et al.
4,165,902 A 8/1979 Ehrlich
4,178,047 A * 12/1979 Welch ..... 312/140
4,244,621 A * 1/1981 Lazaroff et al. ..... 297/248
D266,386 S 10/1982 DiPersia
4,438,603 A 3/1984 Durkan, Jr.
D303,877 S 10/1989 Norton
D304,527 S 11/1989 Miller
D318,183 S 7/1991 Fister et al.
D326,367 S 5/1992 Messina
D360,091 S 7/1995 Hassel et al.
D360,310 S 7/1995 Stamberg et al.
D360,538 S 7/1995 Skalka
D360,995 S 8/1995 Pedersen
D365,937 S 1/1996 Skalka
5,522,182 A 6/1996 Rogers
D373,257 S 9/1996 Hutton
5,573,322 A * 11/1996 Wrobel ..... 312/400
D379,876 S 6/1997 Wood
5,653,507 A 8/1997 Moore
D393,965 S 5/1998 Sandy
D394,561 S 5/1998 Oltmans
D411,061 S 6/1999 Klein
D415,360 S 10/1999 Lewis
D418,338 S 1/2000 Livieratos
D419,008 S 1/2000 Livieratos
D425,319 S 5/2000 Kemnitzer
D425,337 S 5/2000 Hellwig et al.
6,217,120 B1 4/2001 Pugliese
6,241,317 B1 6/2001 Wu
6,279,997 B1 8/2001 Moore et al.
6,367,874 B1 4/2002 Casini
6,367,880 B1 4/2002 Niederman et al.
6,652,208 B1 * 11/2003 Gillis ..... 411/107

* cited by examiner

RECESSED SUPPORT ASSEMBLY

CROSS REFERENCE TO RELATED APPLICATIONS

This application claims the benefit of U.S. Provisional Application Ser. No. 60/384,729, filed on May 31, 2002 and herein incorporated by reference in its entirety.

FIELD OF THE INVENTION

This invention relates in general to a recessed support assembly, and deals more particularly with a recessed support assembly that includes a recessed support typically utilized in pairs to form naturally supporting members upon which the distal ends of a single bridging piece, or multiple bridging pieces, may be correspondingly rested and/or affixed.

BACKGROUND OF THE INVENTION

Chairs, benches and the like have evolved over the years to accommodate not only changes in style, but changes in technology as well. That is, the particular design of support apparatuses has always been driven by a combination of aesthetics and material considerations. What has not changed over the years, however, is the desire to produce high quality support apparatuses, which meet the functional or aesthetic requirements of their owners.

One challenge facing producers of support apparatuses is to design a bench that meets certain criteria, including having a simple, attractive design which is capable of being employed in commercial, residential and public areas. The capability of appearance modification and the ability to be mass produced using a number of materials with differing dimensions has also been problematic, as well as shipping components which facilitate ease of construction at a given destination.

In addition, the manner in which the constituent elements of any support apparatus are held together has a great bearing on the longevity of the support apparatus, as well as bearing on the ability of the support apparatus to withstand environmental and criminal insults.

With the forgoing problems and concerns in mind, the present invention therefore seeks to provide a recessed support assembly which is not only pleasing to the eye, but also one whose configuration may be easily altered to meet many of the design needs of the varying requirements of architects, designers and city planners, including the utilization thereof, all while maintaining the structural integrity of the recessed support assembly, and structure in total.

SUMMARY OF THE INVENTION

The recessed support and bracket may be used in conjunction to support, fasten, and hold rigid the pieces or surfaces supported. The support configuration can also be utilized to support a multitude of requirements including, but not limited to, benches, beds, stackable bookcases, tables and bridge abutments, while utilizing various natural and man made materials. The configuration dimensions may be altered to accept the supported material while maintaining the original concept and utilizing a variety of fastening methods.

Problems of design requirements while keeping structural integrity have been addressed by the present invention. The design may therefore be altered to identify with local architecture and/or enhance a particular setting while keeping the integral structure of the piece intact.

Shipping problems have been addressed by allowing the completed bench to be shipped as separate pieces with completed assembly of the horizontal surface to be supported with minimal effort, time, experience or expense.

Theft is curtailed by the weight and integrity of construction. While some fasteners are apparent to those looking for them, others may be hidden and impossible to remove without taking the side rails off first, which are themselves integrally attached to the top surface. Further security may be accomplished by various methods of affixing the supports themselves to the ground or pavement.

The "wracking" of the completed piece is prohibited as the supported surface is integrally attached to the side pieces, ergo, secured on two adjacent planes, which may be at approximately 90 degrees from each other.

Further, a back may be added at the time of assembly, or later, utilizing a number of different design or fastening methods.

For less expensive or less demanding requirements of stability and integrity, a simple metal, wooden or man made material brace may be utilized in lieu of or in addition to the deigned metal bracket According to one embodiment of the present invention, a recessed support assembly includes a ledge member having an upper portion and an attachment bore formed in the ledge member. A bracket conforms to the upper portion and includes a securement aperture aligned with the attachment bore. A first fastening device extends through the securement aperture and into the attachment bore, thus fixing the bracket to the ledge member. A bridging element is also included and is mated to the bracket via a second fastening device, which extends through an attachment aperture in the bracket and into the bridging element. An operative end of the second fastening device is captured between the bracket and the upper portion of the ledge.

These and other objectives of the present invention, and their preferred embodiments, shall become clear by consideration of the specification, claims and drawings taken as a whole.

DETAILED DESCRIPTION OF THE INVENTION

Figure 1:
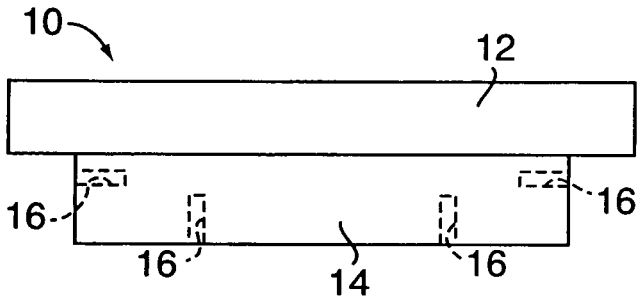
FIG. 1 is a top plan of the recessed support according to one embodiment of the present invention.

FIG. 1 illustrates a top view of a recessed support 10, according to one embodiment of the present invention. As shown in FIG. 1, the recessed support 10 includes an upright member 12 and a ledge member 14. Although shown as two distinct pieces in FIG. 1, the upright member 12 and the ledge member 14 may alternatively be formed integral with one another without departing from the broader aspects of the present invention.

As also shown in FIG. 1, the ledge member 14 includes a plurality of attachment bores 16 formed therein. The attachment bores 16 are themselves utilized to anchor a non-illustrated support bracket, which will be described in more detail later. The bores 16 may be integrally formed with the ledge member 14 or, in the preferred method, drilled in the ledge member 14 after formation of the ledge member 14. It will be readily appreciated that the recessed support 10 is used in pairs as matching ends for supporting an elevated bridging element, or elements, as will also be described in more detail later.

Figure 2:
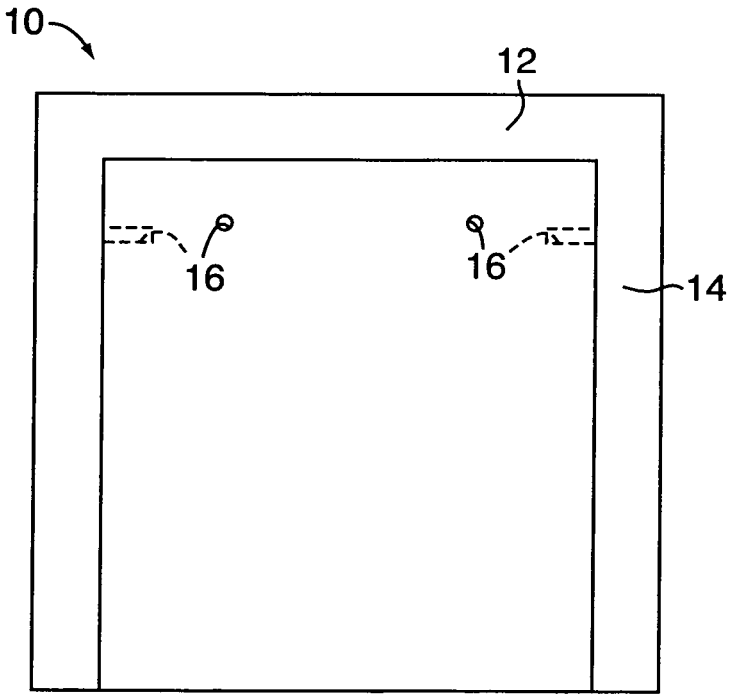
FIG. 2 is a front elevational view of the recessed support illustrated in FIG. 1.
Figure 3:
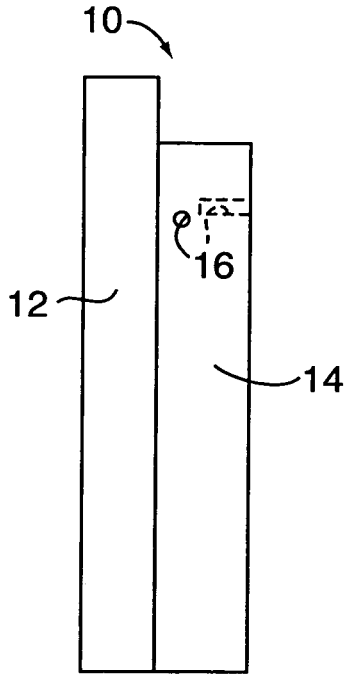
FIG. 3 is a side elevation view of the recessed support illustrated in FIG. 1.
Figure 4:
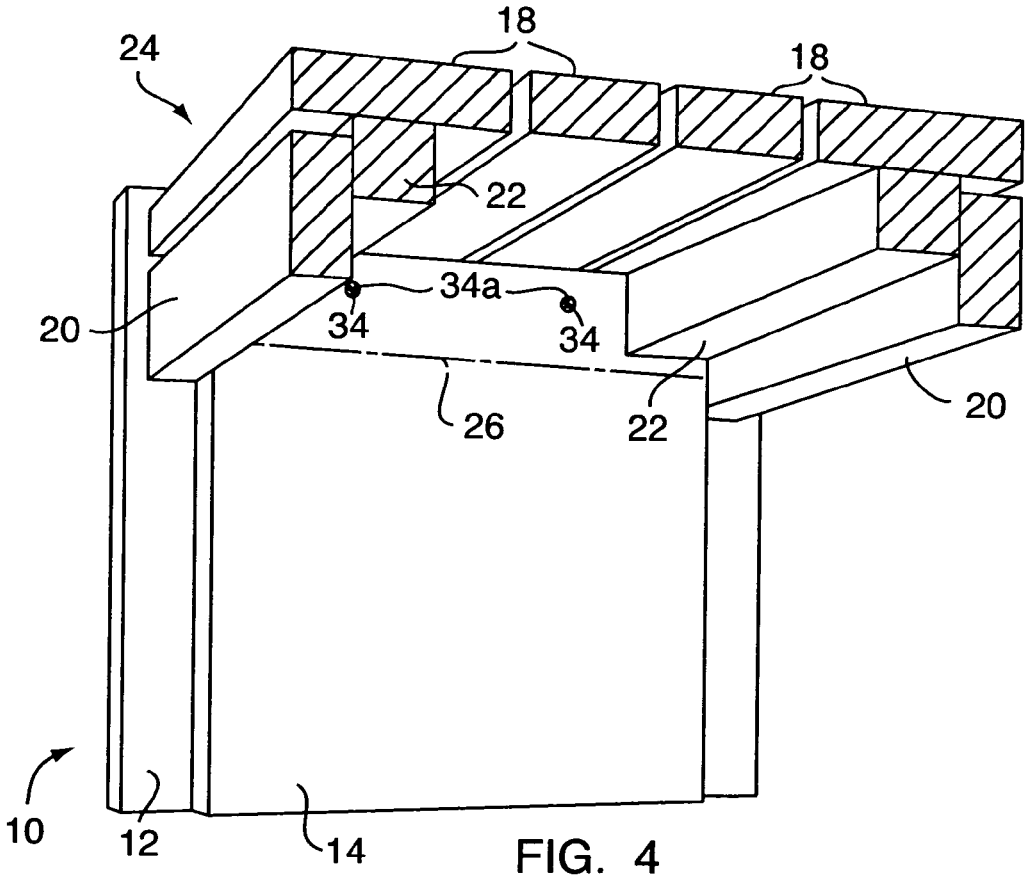
FIG. 4 is a partial cross-sectional perspective view of the recessed support assembly according to one embodiment of the present invention.
Figure 5:
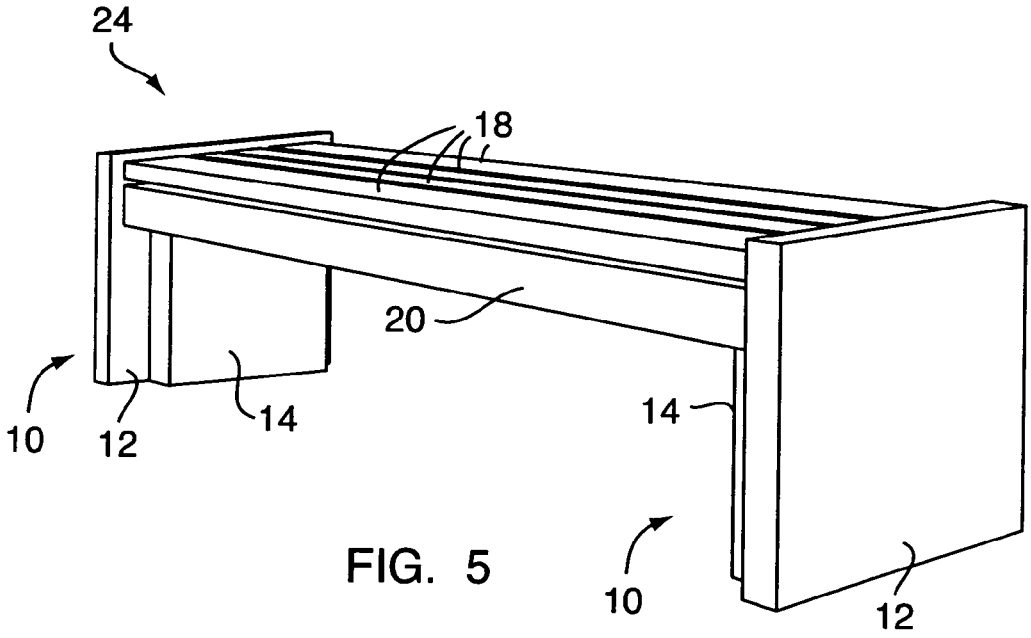
FIG. 5 is a perspective view of the recessed support illustrated in FIGS. 1–3.

FIG. 2 illustrates a front elevational view of the recessed support 10, while FIG. 3 illustrates a side view of the recessed support 10. FIG. 4 depicts the recessed support 10 as it is utilized to support a plurality of horizontally oriented bridging elements 18. Moreover, as shown in FIG. 4, a pair of vertically oriented side elements 20 are affixed to a matching pair of inner, longitudinal brace elements 22 which are themselves fixedly connected to the bridging elements 18. The brace elements 22 serve to not only provide a surface upon which to hang the side elements 20, but also act with the side elements 20 to prevent racking or twisting of a recessed support assembly 24, as shown in FIG. 4. FIG. 5 illustrates one proposed embodiment of the recessed support assembly 24 wherein a pair of the recessed supports 10 are utilized to form opposing ends of an integrated bench.

It will be readily appreciated that the recessed support 10 of the present invention may be fabricated from stone, metal, wood, composite, plastics, concrete or other aggregates, natural or man made materials or other non-descript materials. In a similar vein, the bridging elements 18, as well as the side elements 20 and the brace elements 22, may also be constructed from any known material without departing from the broader aspects of the present invention.

The upright member 12 may be horizontal, convex, concave or comprise a wave configuration, allowing for various seating or supporting designs, as is shown in the alternative embodiments depicted in FIGS. 6–9. As specifically shown in FIGS. 6–8, the ledge member 14 may also include convex, concave or other wave profiles which can be combined with similarly curved profiles of the upright member 12 to produce a large number of possible shape permutations for the recessed support assembly 24. Common to each of these configurations is that the distal ends of the bridging elements 18 are supported upon the ledge member 14 and affixed thereto. In this regard, the bridging elements 18 may be affixed to the ledge member 14 by a multitude of fastening methods including, but not limited to, screws, bolts, complimentary fixtures, pegs, nails, adhesives, cohesive forces, brackets or other methods or braces, as will be described in more detail later.

Figure 10:
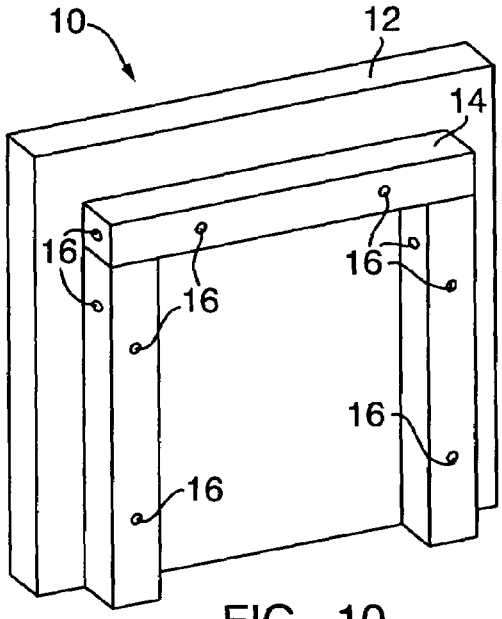
FIG. 10 is a front elevational view of the recessed support in a design-modified form, according to another embodiment of the present invention.
Figure 11:
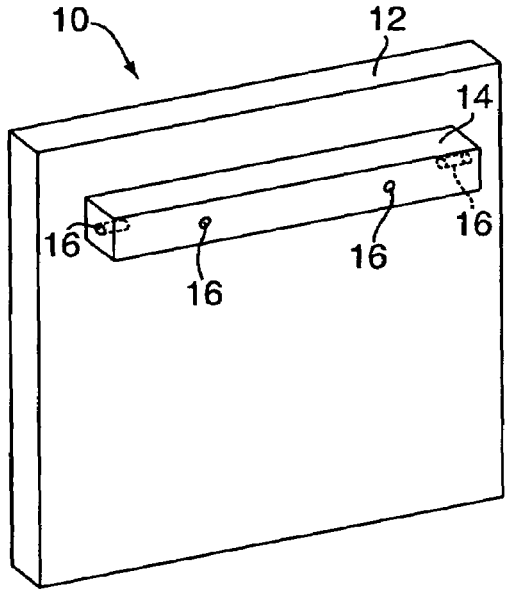
FIG. 11 is the recessed support in a design-modified form, according to another embodiment of the present invention.
Figure 12:
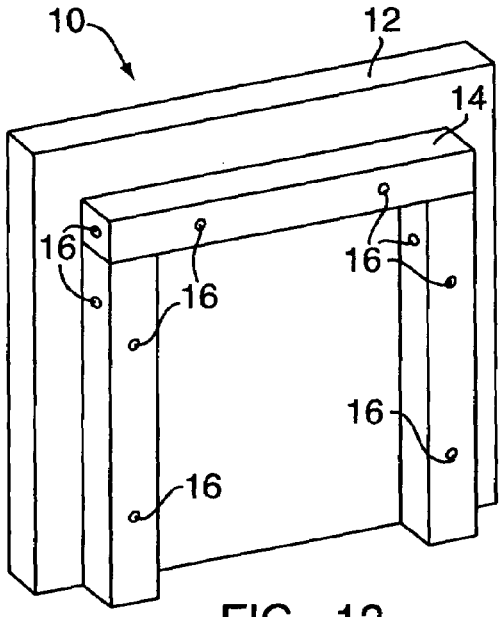
FIG. 12 is a front elevational view of the recessed support in a design-modified form, according to another embodiment of the present invention.

Although the ledge member 14 has been shown as being substantially coextensive with the planar surface of the upright members 10, the present invention is not limited in this regard. As shown in FIG. 10, the ledge member 14 may instead be formed from three rectangular support members with associated bores 16 formed therein. FIGS. 11 and 12 show even more alternative embodiments of the recessed support 14.

Figure 13:
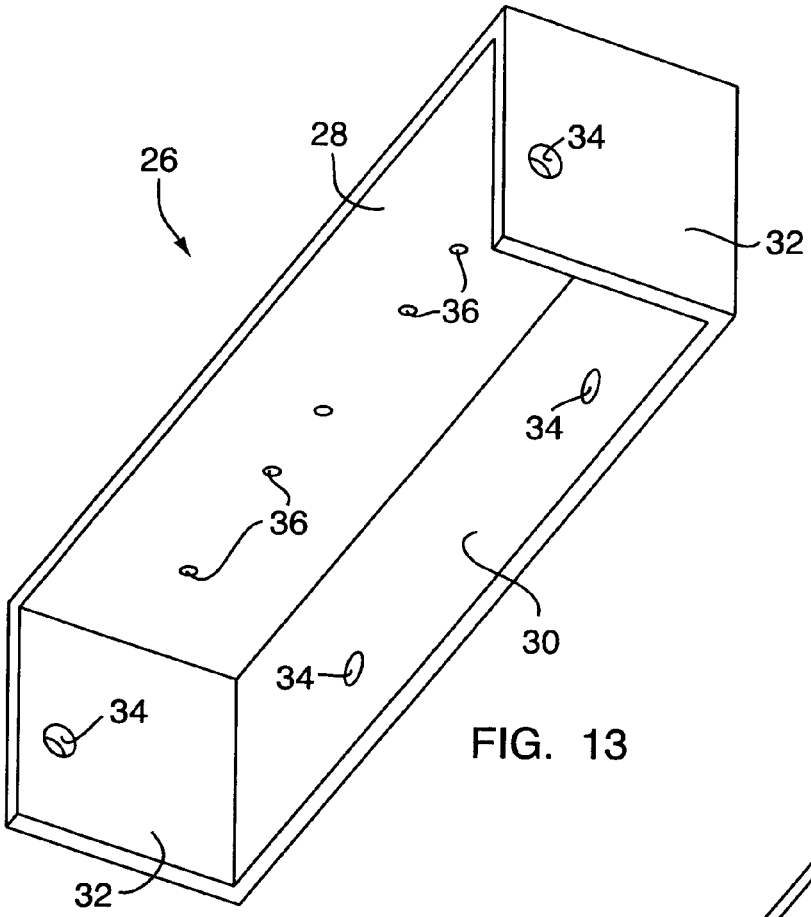
FIG. 13 is a perspective view of a cooperating bracket with ends, according to one embodiment of the present invention.

As discussed previously, one preferred method of attaching the bridging elements 18 to the recessed support 10 is the use of a preformed bracket 26, which may be affixed to the ledge member 14 as well as to the bridging element(s) 18. FIG. 13 illustrates a preferred embodiment of the preformed bracket 26 which includes a horizontal segment 28 and a vertical segment 30 disposed approximately 90° from one another. As also shown in FIG. 13, the bracket 26 further includes a pair of bracket end caps 32 arranged on either distal end of the bracket 26.

The bracket 26 is preferably formed from a thick gauge metal and includes a plurality of securement apertures 34 which are spaced so as to conform to the plurality of bores 16 formed in the ledge member 14, shown in FIGS. 1–3. A plurality of attachment apertures 36 are also formed through the horizontal segment 28 and are themselves utilized to fixedly hold the bridging elements 18 in place.

Figure 6:
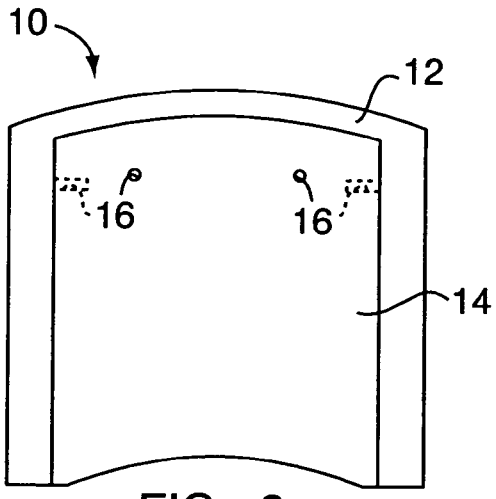
FIG. 6 is a front elevational view of the recessed support in a design-modified form, according to another embodiment of the present invention.
Figure 7:
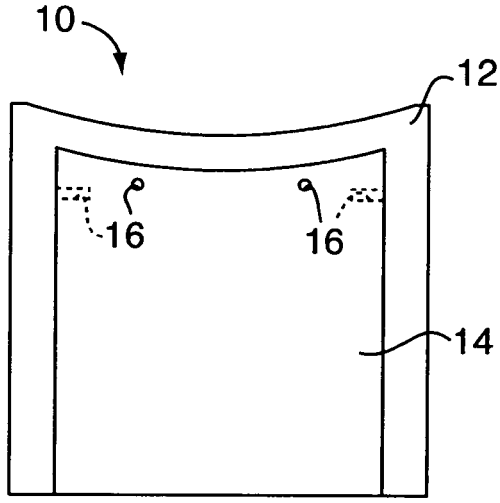
FIG. 7 is a front elevational view of the recessed support in a design-modified form, according to another embodiment of the present invention.
Figure 8:
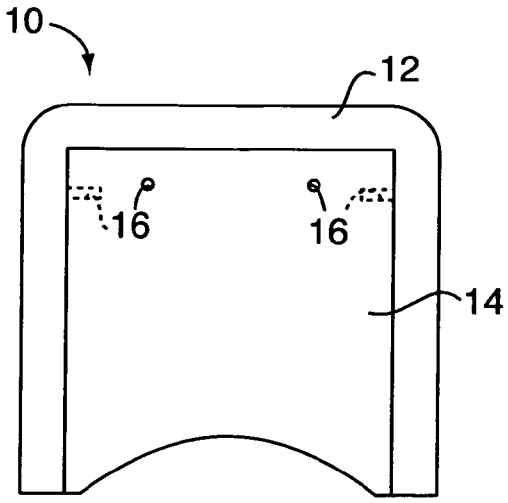
FIG. 8 is a front elevational view of the recessed support in a design-modified form, according to another embodiment of the present invention.
Figure 9:
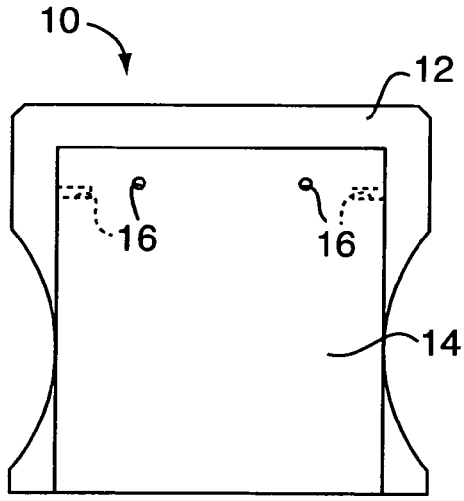
FIG. 9 is a front elevational view of the recessed support in a design-modified form, according to another embodiment of the present invention.
Figure 14:
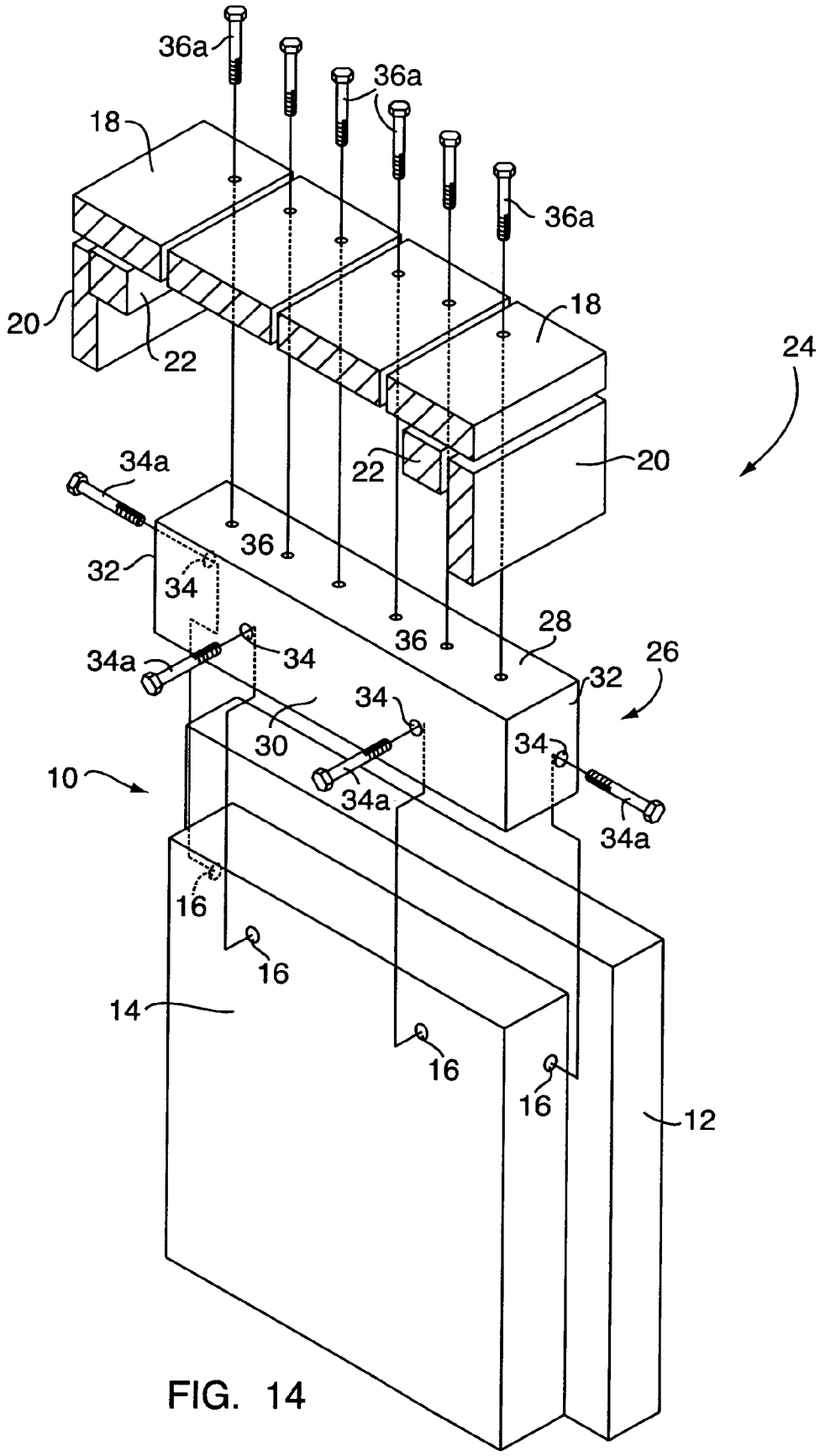
FIG. 14 illustrates the use of the bracket illustrated in FIG. 13.

FIG. 14 illustrates the method of attaching the bracket 26 to the recessed support 10. As shown in FIG. 14, the bracket 26 is placed over the upper surface of the ledge member 14, thereby aligning the bores 16 with the securement apertures 34. A plurality of first fastening devices 34*a*, i.e. expansion bolts, or the like, are then utilized to secure the bracket 26 to the ledge member 14 leaving the attachment apertures 36 free to fix the bridging elements 18 thereto. A plurality of second fastening devices 36*a*, i.e., expansion bolts or the like, are then utilized to secure the bracket 26 to the bridging elements 18. It should be noted that the preferred method of assembly includes securing the bracket 26 to the bridging elements 18 prior to fixing the bracket 26 to the ledge member 14, however combining the elements of the present invention in a differing sequence is also contemplated by the present invention. Moreover, it will be readily appreciated that the bracket 26 is sized and shaped to accommodate the profile of any particular ledge member 14, including those having curved or wave-form profiles as depicted in FIGS. 6–8.

Construction of the recessed support assembly 24 will now be described in conjunction with FIGS. 4, 5 and 14. As previously discussed, the recessed support 14 and the bracket 26 are first formed having a matching, and aligned, plurality of bores 16 and securement apertures 34. Prior to securing the bracket 26 to the ledge member 14, the bridging elements 18 are affixed to the bracket 26 by screwing up through the attachment apertures 36 and into the horizontal bridging elements 18. While a screwing operation has been described, the present invention is not limited in this regard as alternative methods and similar devices may be utilized without departing from the broader aspects of the present invention, provided that they extend up through the attachment apertures 36 and into the horizontal bridging elements 18.

It is therefore an important aspect of the present invention that the underside of the bridging elements 18 are secured to the bracket 26 so as not to mar the surface of the bridging elements 18 once the recessed support assembly 24 is fully assembled. Moreover, by attaching the bridging elements 18 in such a manner, the present invention effectively hides the screws, or the like, which are utilized to fixedly attach the bridging elements 18 to the bracket 26 and thereby effectively ensures that the ledge member 14 and the bridging elements 18 may not be disengaged from one another, as will be discussed in more detail later.

Returning to FIGS. 4, 5 and 14, after the bridging elements 18 have been affixed to the bracket 26, the bracket 18 is then arranged over the upper surface 38 of the ledge member 14. Once so positioned, a plurality of expansion bolts, or the like, are then used to fixed mate the securement apertures 34 of the bracket 18 to the bores 16 of the ledge member 14, thus firmly seating the bracket 26 to the ledge member 14. As mentioned above, once the bracket 26 is firmly seated upon the ledge member 14, the operative end of the screws utilized to affix the bridging elements 18 to the bracket 26 are effectively hidden and captured between the bracket 26 and the ledge member 14.

In order to prevent racking of the recessed support assembly 24 as a whole, a pair of the brace elements 22 may be position underneath the bridging elements 18, along the longitudinal sides of the recessed support assembly 24. The brace elements 22 may then be attached to the bridging elements 18 by screwing, or otherwise fastening, up through the brace elements 22 and into the bridging elements 18. Thus, the exterior surface of the bridging elements 18 are maintained free from any observable fastening mechanism and are therefore more aesthetically appealing.

A pair of the side elements 24 may also be attached to the brace elements 22 and also help protect the recessed support assembly 24 from warping or racking over time. The side elements 20 also add to the aesthetic nature of the recessed support assembly 24 while hiding the expansion bolts positioned through each of the securement apertures 34 formed in the bracket end caps 32.

It is therefore another important aspect of the present invention that, once attached to the brace elements 22 via screws or the like, the side elements 20 hide the expansion bolts positioned through each of the securement apertures 34 formed in the bracket end caps 32, thereby effectively frustrating any attempt by thieves, vandals or the like from having access to the fasteners of the recessed support assembly 24. Moreover, the end caps 32 of the bracket 26 also enable the bracket 26 to be affixed to the ledge member 14 on three separate planes for greater securement thereto. As discussed previously, the bridging elements 18 and the side elements 20 may then overlay the bracket 26 itself, thereby covering the bracket 26 from sight.

Figure 15:
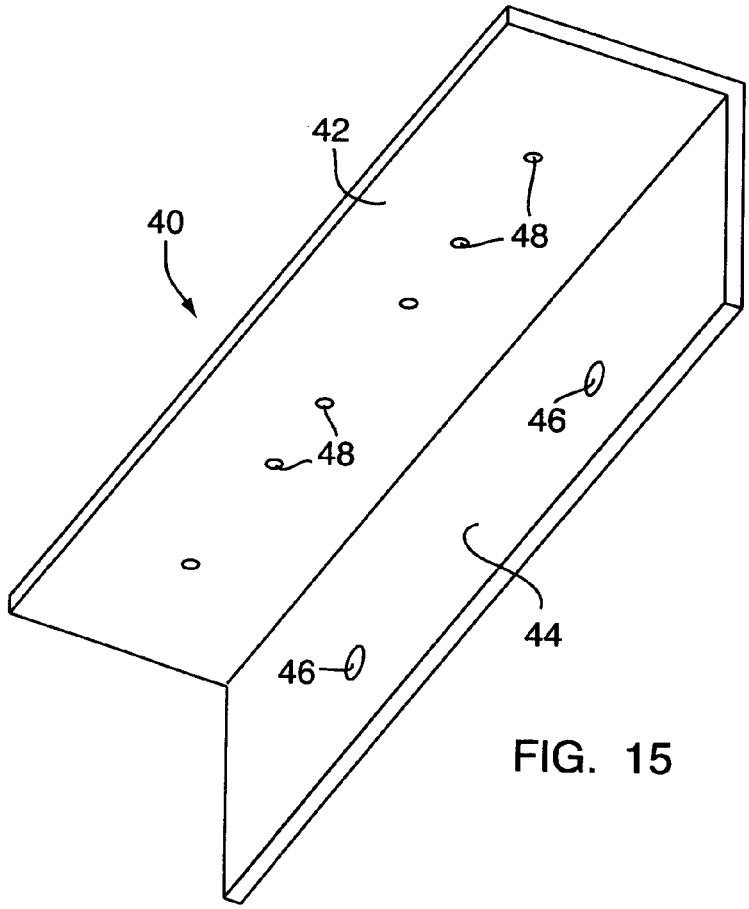
FIG. 15 is a perspective view of a cooperating bracket without ends, according to another embodiment of the present invention

While the bracket 26 has been shown in its preferred embodiment in FIG. 13, other structural configurations of the bracket may be employed as well. FIG. 15 illustrates an alternative bracket 40, which includes a horizontal segment 42 and a vertical segment 44 disposed approximately 90° from one another. As also shown in FIG. 13, the bracket 40 does not include pair of bracket end caps, such as were arranged on either distal end of the bracket 26.

Figure 16:
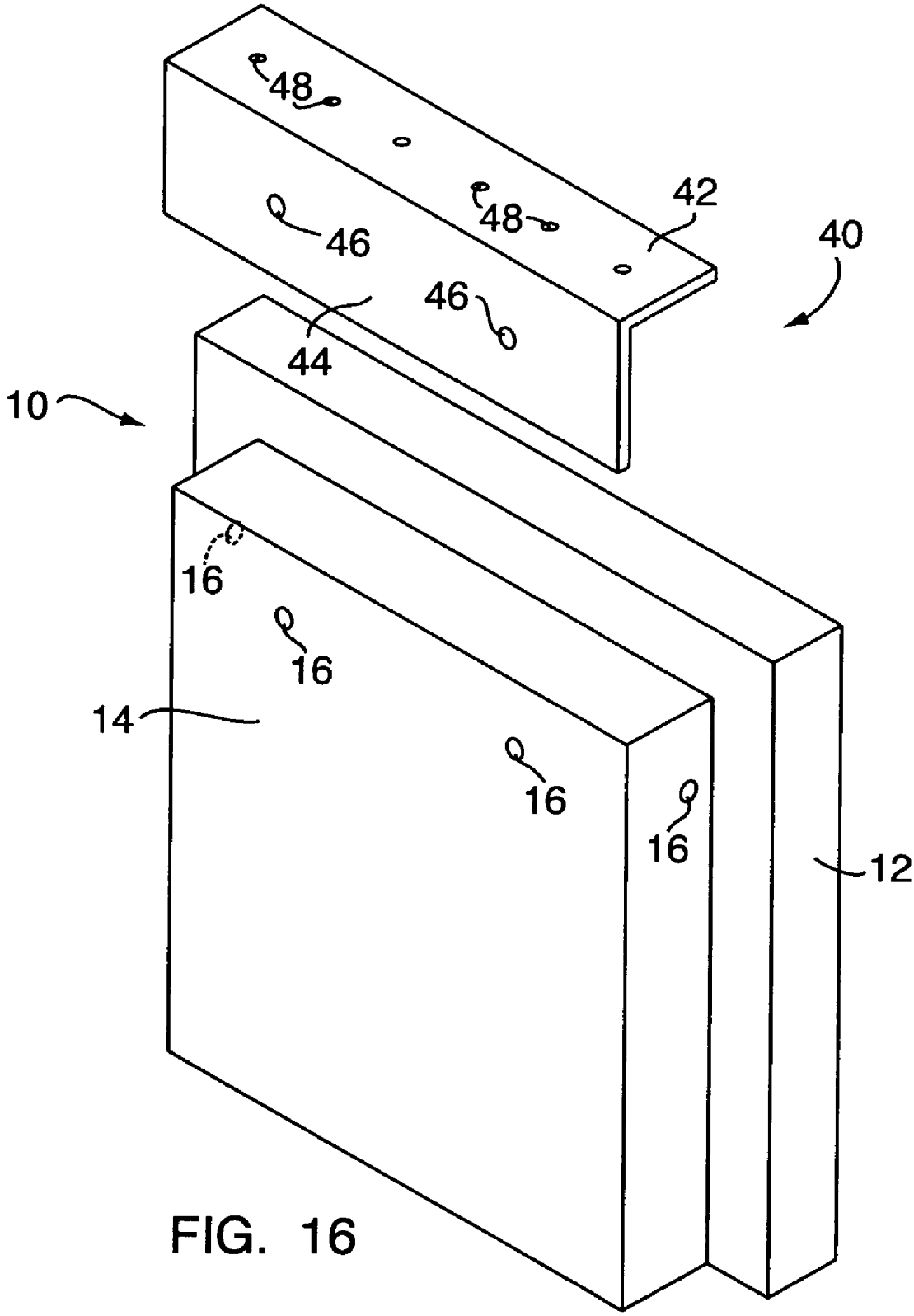
FIG. 16 illustrates the use of the bracket illustrated in FIG. 15.

The bracket 40 is preferably formed from a thick gauge metal and includes a plurality of securement apertures 46, which are spaced so as to conform to the plurality of bores 16 formed in the ledge member 14. A plurality of attachment apertures 48 are also formed through the horizontal segment 42 and are themselves utilized to fixedly hold the bridging elements 18 in place, as discussed in conjunction with the bracket 26. It should be noted that it is still possible to utilize both the side elements 20 and the brace elements 22 with the bracket 40, which may be utilized for temporary installations or where rapid assembly and disassembly of the recessed support assembly 24 may be required, or desired, criteria. FIG. 16 depicts the bracket 40 as it is mounted upon the ledge member 14 according to this alternative embodiment of the present invention.

Figure 17:
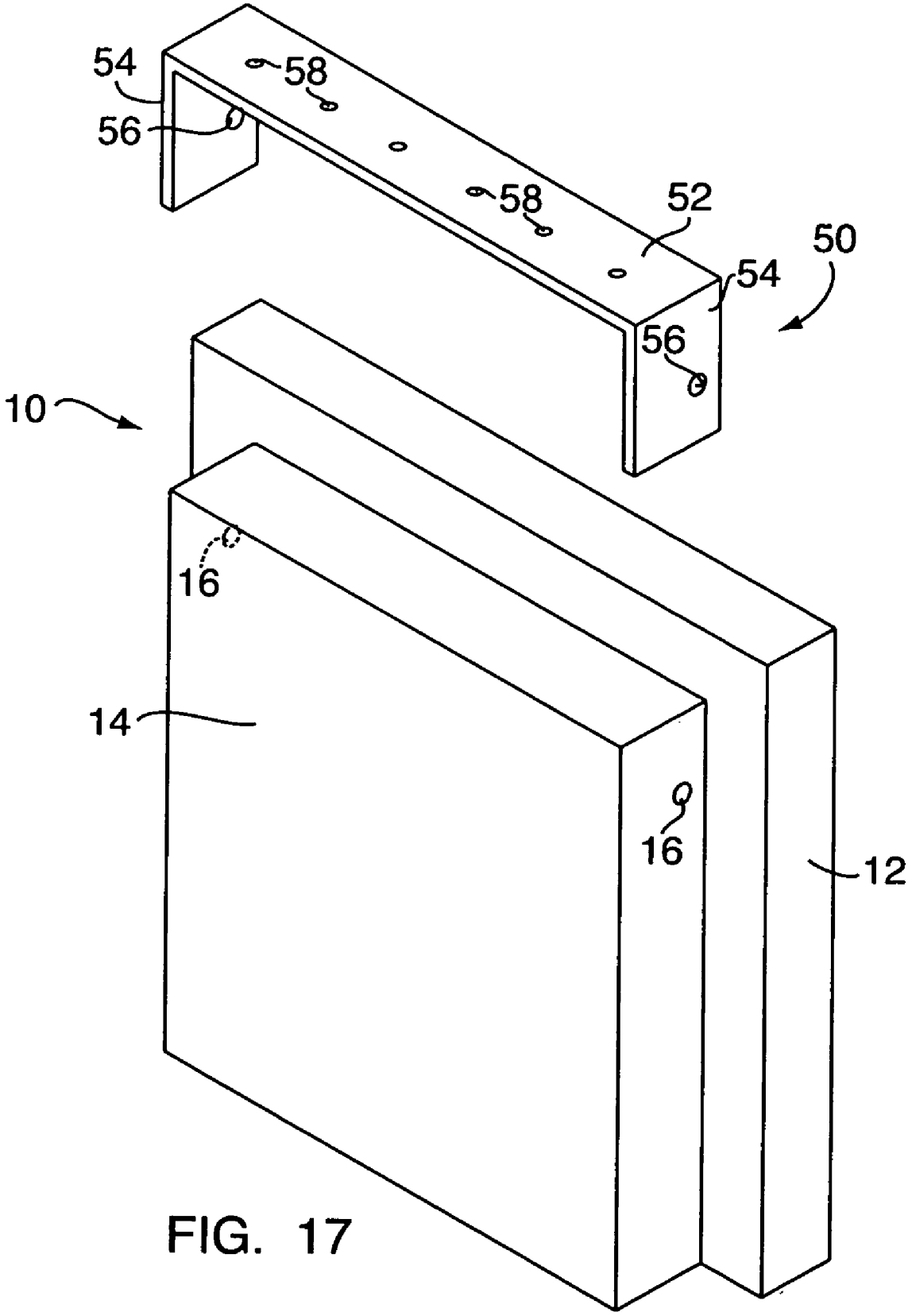
FIG. 17 illustrates the use of a cooperating bracket according to another embodiment of the present invention.

FIG. 17 illustrates an alternative bracket 50 which includes a horizontal segment 52 and a pair of end caps, or wing members, 54 disposed on either distal end of the horizontal segment 52. The bracket 50 is preferably formed from a thick gauge metal and includes a plurality of securement apertures 56, which are spaced so as to conform to the plurality of bores 16 formed in the ledge member 14. A plurality of attachment apertures 58 are also formed through the horizontal segment 52 and are themselves utilized to fixedly hold the bridging elements 18 in place, as discussed in conjunction with the bracket 26. It should be noted that it is still possible to utilize both the side elements 20 and the brace elements 22 with the bracket 50 which, as compared to the securement of the bracket 26, may be utilized for temporary installations or where rapid assembly and disassembly of the recessed support assembly 24 may be a required, or desired, criteria or utilized where no assembly hardware may be visible from any perspective.

Figure 18:
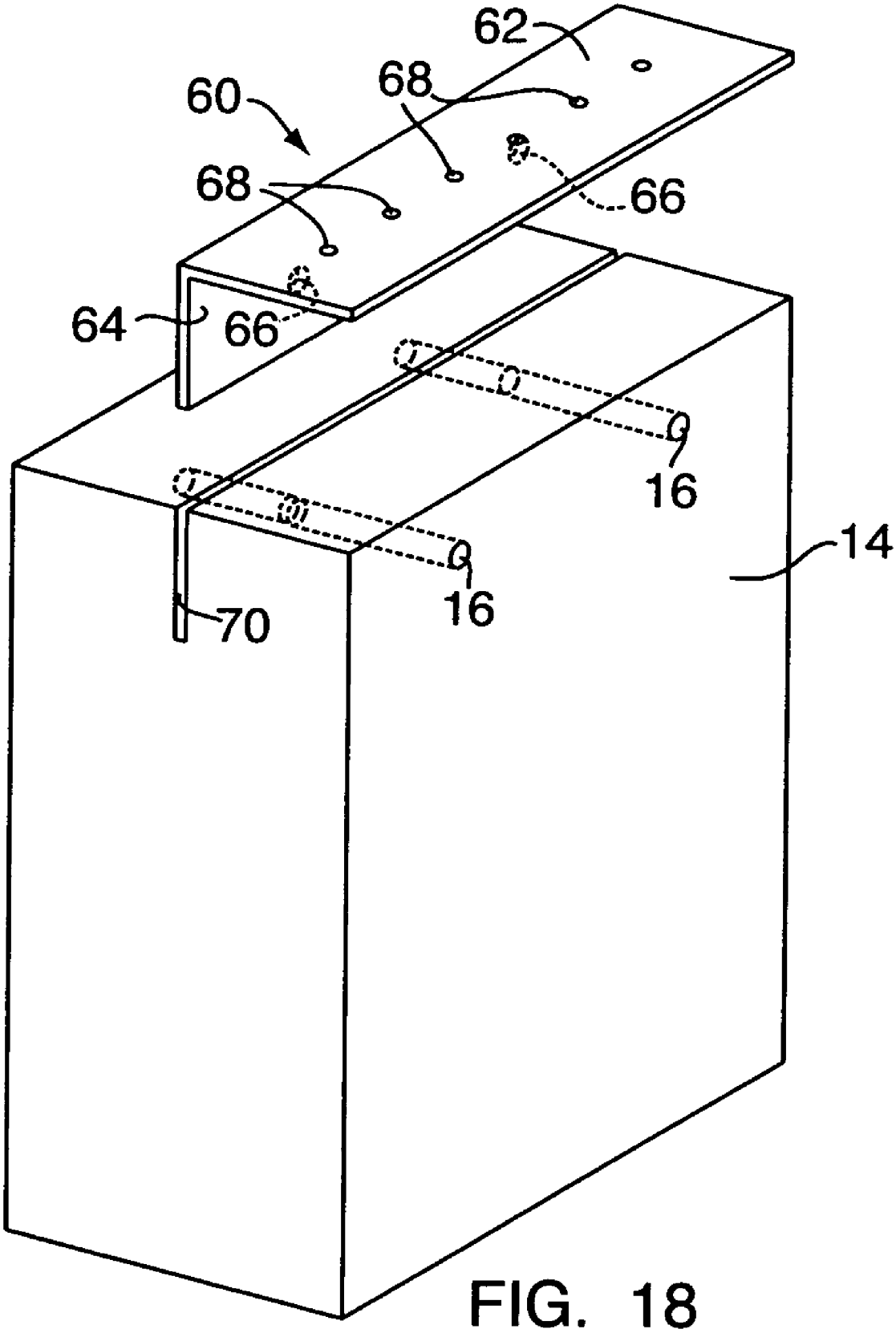
FIG. 18 illustrates the use of a cooperating bracket according to another embodiment of the present invention.

FIG. 18 illustrates yet another alternative bracket 60 which includes a horizontal segment 62 and a vertical segment 64, similar to the bracket 40 shown in FIGS. 15 and 16. The bracket 60 is also preferably formed from a thick gauge metal and includes a plurality of securement apertures 66 which are formed in the vertical segment 64 and are spaced so as to conform to the plurality of bores 16 formed in the ledge member 14. A plurality of attachment apertures 68 are themselves formed through the horizontal segment 62 and are themselves utilized to fixedly hold the bridging elements 18 in place, as discussed in conjunction with the bracket 26. It should again be noted that it is still possible to utilize both the side elements 20 and the brace elements 22 with the bracket 60 which, as compared to the securement of the bracket 26, may be utilized for temporary installations or where rapid assembly and disassembly of the recessed support assembly 24 may be required, or desired, criteria.

As will be appreciated from a review of the bracket 60 in FIG. 18, the bracket 60 does not merely overlay the ledge member 14, as was shown in conjunction with the previously described brackets, 26, 40 and 50. In contrast, the bracket 60 is instead inserted into an engagement slot 70 so as to align the securement apertures 66 with the bores 16. Vandal proof bolts, or the like, may then be utilized to secure the bracket 60 to the ledge member 14. Although FIG. 18 does not show the use of an upright member integrally attached to the ledge member 14, it will be readily appreciated that such an upright member may be employed without departing from the broader aspects of the present invention.

While FIGS. 13–18 depict brackets having a mixture of horizontal, vertical and end cap planes arranged approximately 90° from one another, the present invention is not so limited in this regard as the various constituent planes of the brackets illustrated in FIGS. 13–18 may be at any angle from one another, provided that they conform to the exterior profile of the ledge member 14.

Figure 19:
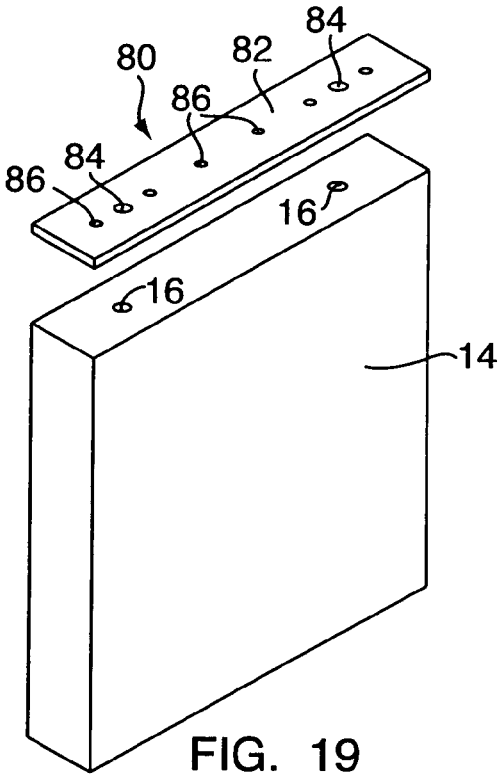
FIG. 19 illustrates the use of a cooperating bracket according to another embodiment of the present invention.

The simplest form of alternative bracket contemplated by the present invention is illustrated in FIG. 19 where a single plane bracket 80 is illustrated. As shown in FIG. 19, the bracket 80 includes only a horizontal segment 82. The bracket 80 is also preferably formed from a thick gauge metal and includes a plurality of securement apertures 84 which are formed in the horizontal segment 82 and are spaced so as to conform to the plurality of bores 16 formed in the ledge member 14, as well as a plurality of attachment apertures 86 which are also formed through the horizontal segment 82 and are themselves utilized to fixedly hold the bridging elements 18 in place, as discussed in conjunction with the bracket 26.

Figure 20:
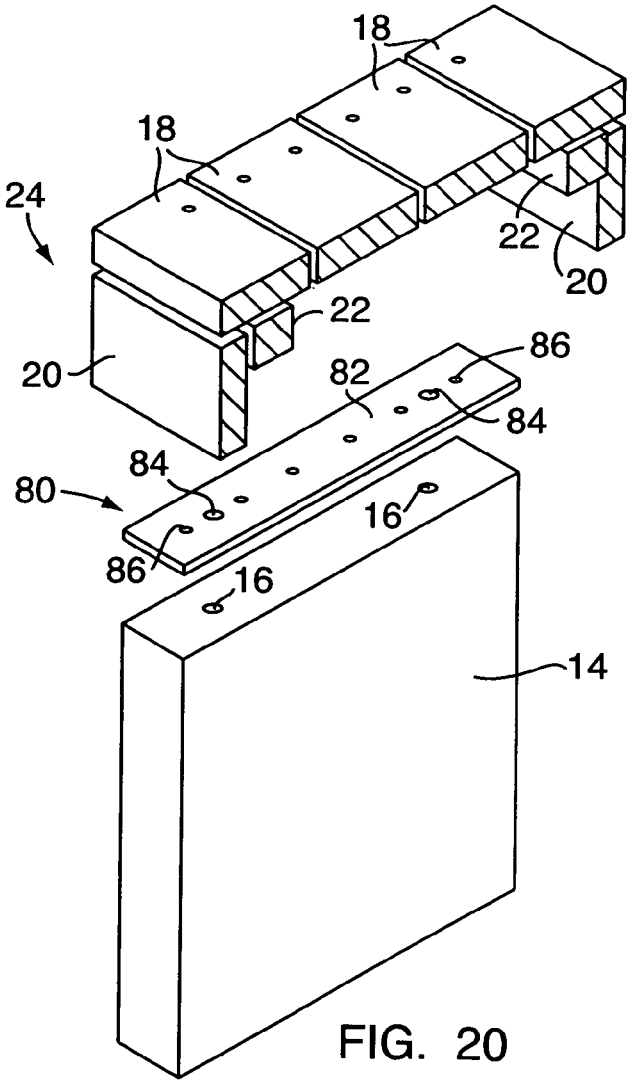
FIG. 20 illustrates the use of the bracket illustrated in FIG. 19.

FIG. 20 illustrates the use of the bracket 80 as it facilitates the fastening of the bridging elements 18, the brace elements 22 and the side elements 20 to the superstructure of the ledge member 14. Although FIG. 19 does not show the use of an upright member integrally attached to the ledge member 14, it will be readily appreciated that such an upright member may be employed without departing from the broader aspects of the present invention.

While the foregoing drawing Figures have illustrated differing structural configurations of the brackets used to help integrally fasten the recessed support assembly 24, FIGS. 21–25 depict alternative structural configurations of the ledge member 14 and the upright member 12.

Figure 21:
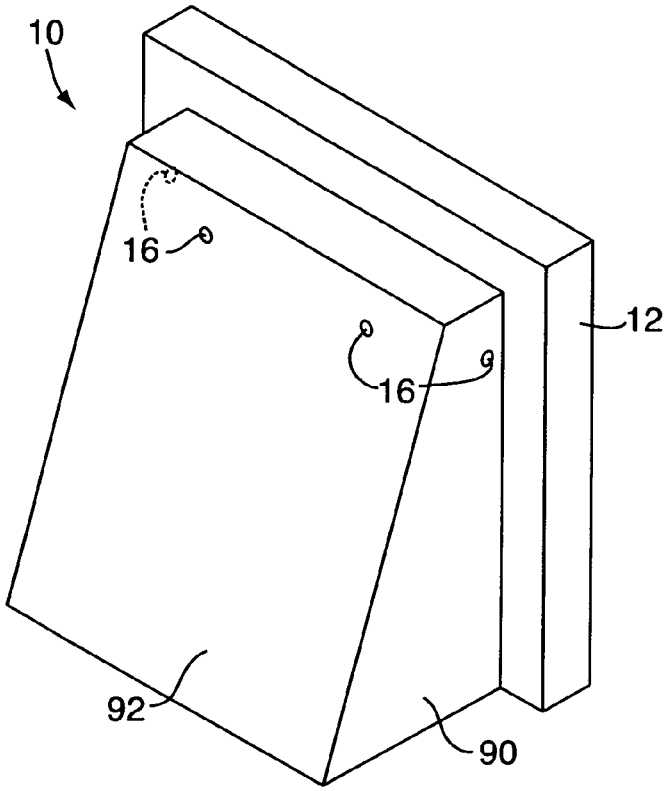
FIG. 21 is a front elevational view of the recessed support in a design-modified form, according to another embodiment of the present invention.
Figure 22:
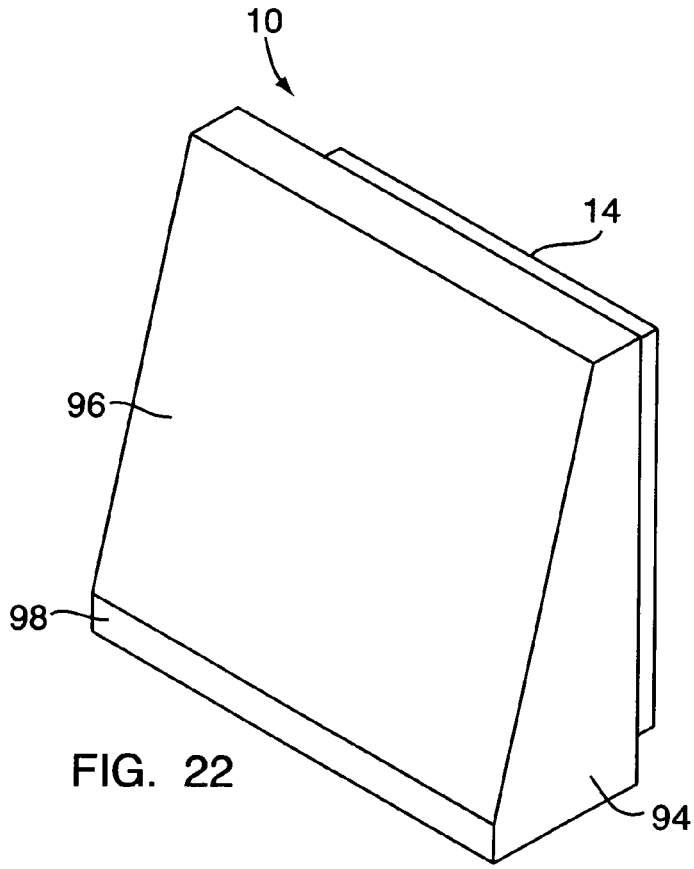
FIG. 22 is a front elevational view of the recessed support in a design-modified form, according to another embodiment of the present invention.

As shown in FIG. 21, a ledge member 90 is illustrated integrally attached to the upright member 12. The ledge member 90 includes a sloping front face 92 having a plurality of bores 16 formed therein for securing any of the previously described brackets thereto, in dependence upon the particular structural configuration of the bracket utilized. In FIG. 22 this arrangement is substantially reversed with the ledge member 14 being planar and the upright member 94 being formed to include a sloping front face 96. The toe 98 of the upright member 94 may be attenuated as shown in FIG. 22 for the sake of extending the life of the recessed support 10, if so desired.

Figure 23:
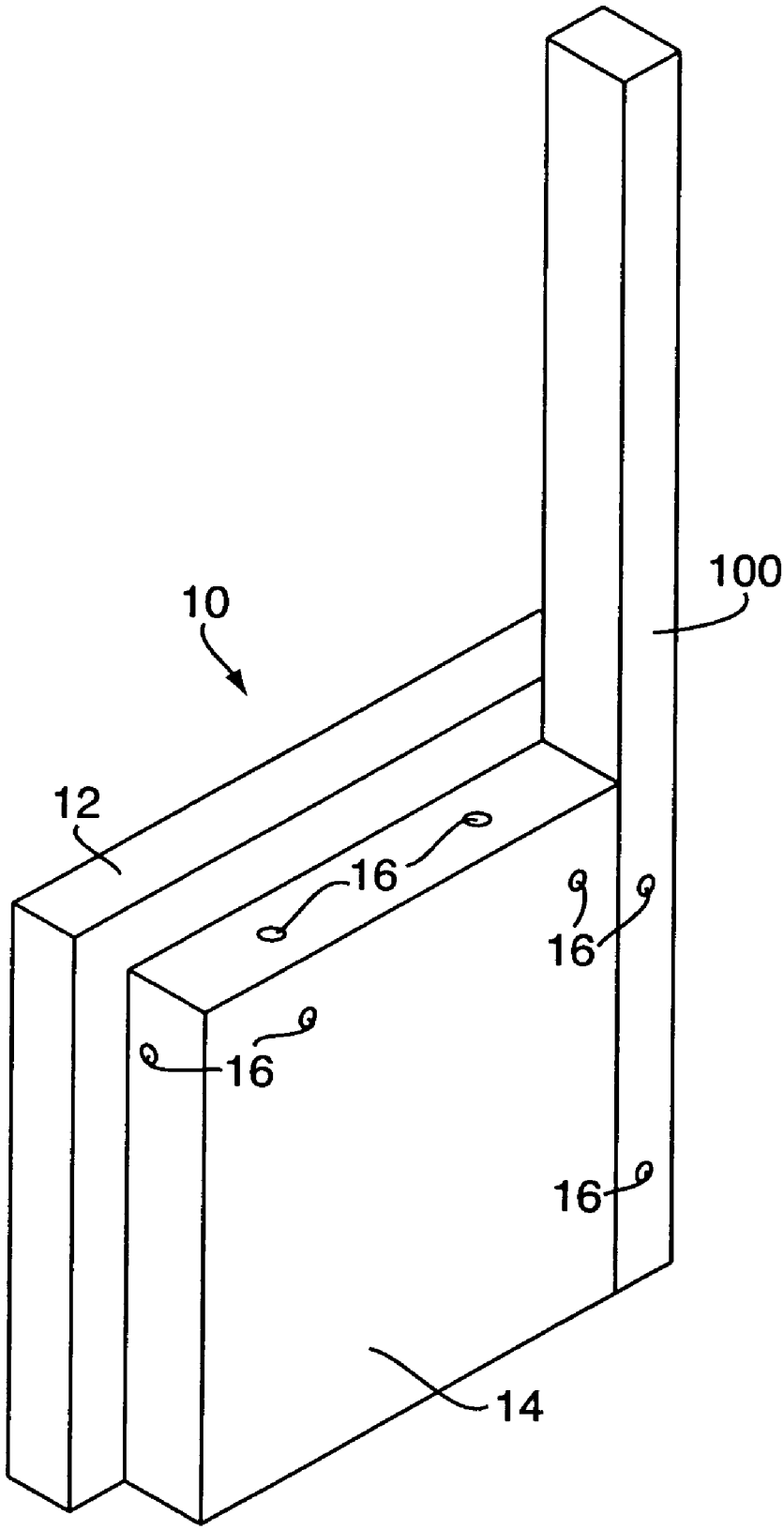
FIG. 23 is a front elevational view of the recessed support in a design-modified form, according to another embodiment of the present invention.

FIG. 23 illustrates a recessed support 10 having both a planar upright member 12, and a planar ledge member 14 having a back extension 100. The back extension 100 may be utilized to support back rest for the recessed support assembly if such is desired.

Figure 24:
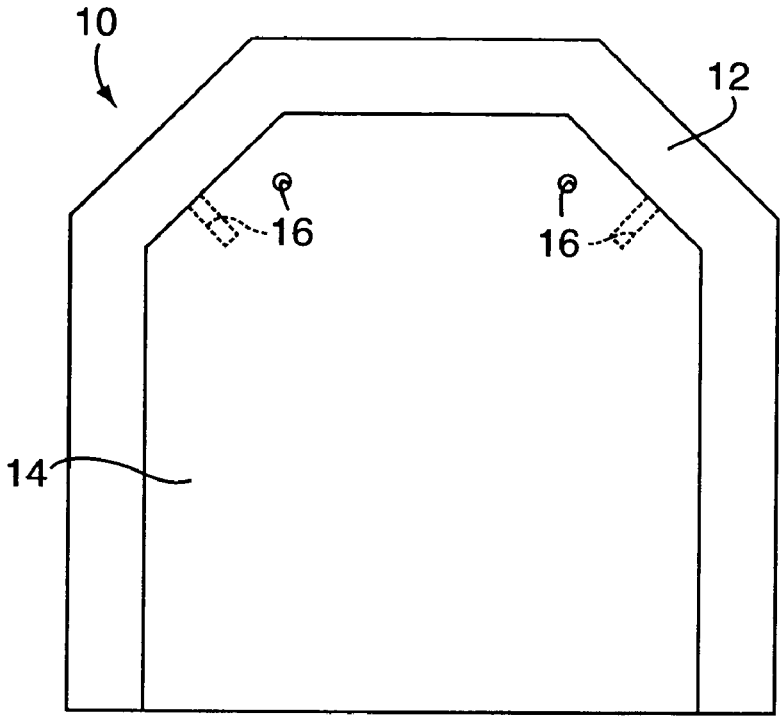
FIG. 24 is a front elevational view of the recessed support in a design-modified form, according to another embodiment of the present invention.
Figure 25:
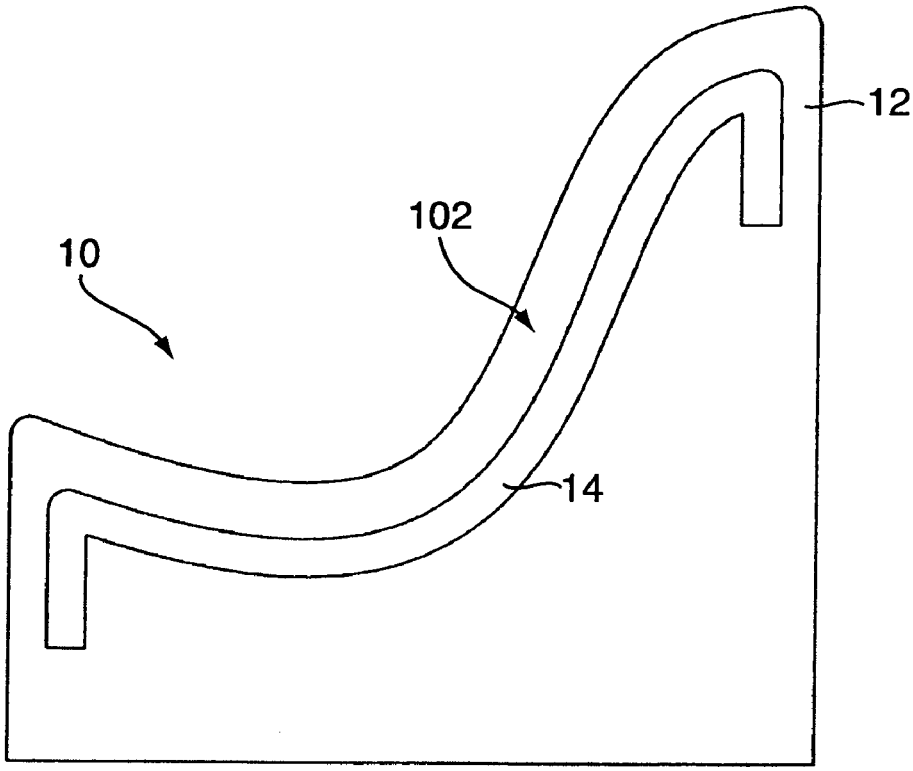
FIG. 25 is a front elevational view of the recessed support in a design-modified form, according to another embodiment of the present invention.

FIG. 24 is yet another example of both the upright member 12 and the ledge member 14 having a contoured profile to which the various brackets described herein would conform. FIG. 25 illustrates a recessed support 10, which includes the upright member 12 having an integrally formed backrest portion 102. Moreover, FIG. 25 further illustrates that the ledge member 14 follows the curved profile of the upright member 12 extending outwardly from the upright member 12, similar to the structural orientation of the ledge members depicted in FIGS. 10–12.

Although the present invention has described the recessed support acting as a bench, the present invention is not limited in this regard. Indeed, the present invention contemplates that the recessed support may be equally adaptable to alternative constructs, such as a table, a bed, a couch, a stand, a bridge and a bookcase or other shelving or surface elevated above the ground.

As discussed previously, the recessed support is used in pairs to form naturally supporting members upon which the distal ends of a single bridging piece, or multiple bridging pieces, may be rested. Using the brackets, the bridging element(s) may be secured to create a ridged configuration of support, and the recessed support may itself be constructed with or without internal fiber, wire, rod, mesh or other means of reinforcement.

The recessed supports of the present invention may be prefabricated, thereby enabling reproduction at one or more de-centralized locations, while the design may be modified to yield multiple designs while maintaining structural integrity through the use of one or more means of reinforcement.

The brackets described herein are utilized to provide an integral median between the recessed support and the bridging element(s) supported thereon. The bracket is fixed to the recessed support and conforms to the ledge member.

While the side elements have been described, in certain embodiments, as covering the end caps of those brackets employing the same by extending approximately parallel to the bridging element(s), the present invention is not limited in this regard as the side elements any be fixed at any angle to the bridging element(s) without departing from the broader aspects of the present invention. Similarly, while the brackets depicted herein have been described as being formed from a heavy gauge metal, it will be readily appreciated that they may instead be formed from any known plastic, polymer, ceramic or other resilient materials, especially non-rusting materials, without departing from the broader aspects of the present invention.

It will also be readily appreciated that the recessed support assembly of the present invention may be stacked, oriented end-to-end or otherwise integrally constructed with other recessed support assemblies to form whatever configuration is demanded by the chosen application. Moreover, while the recessed support of the present invention has been described as being primarily utilized in pairs to form a recessed support assembly, such as a free standing bench, the present invention is not limited in this regard as it is envisioned that only a single recessed support may be utilized whereby the free end of the bridging elements not connected to the recessed support may be affixed to an existing wall, or the like, in any conventional manner.

While the invention had been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A support assembly, comprising:

a ledge member with an attachment bore formed therein, said ledge member having an upper portion;

a bracket that conforms to said upper portion, said bracket including a securement aperture aligned with said attachment bore;

a first fastening device extending through said securement aperture and into said attachment bore, thereby fixing said bracket to said ledge member;

a bridging element mated to said bracket via a second fastening device, said second fastening device extending through an attachment aperture in said bracket and into said bridging element;

said second fastening device having an operative end that is captured between said bracket and said upper portion of said ledge;

said bracket being formed from a first segment and an integrally connected second segment disposed at an angle from said first segment;

said securement aperture is formed in said first segment and said attachment aperture is formed in said second segment; and wherein said second segment conforms to said upper portion of said ledge member and said first segment conforms to a face of said ledge member.

* * * * *